US011193713B2

(12) United States Patent
Wang et al.

(10) Patent No.: US 11,193,713 B2
(45) Date of Patent: Dec. 7, 2021

(54) INDUSTRIAL KILN

(71) Applicant: NANJING SHIHENG ELECTRONICS CO., LTD., Jiangsu (CN)

(72) Inventors: Vang Wang, Jiangning Nanjing (CN); Xueting Wang, Jiangning Nanjing (CN)

(73) Assignee: NANJING SHIHENG ELECTRONICS CO., LTD., Jiangsu (CN)

( * ) Notice: Subject to any disclaimer, the term of this patent is extended or adjusted under 35 U.S.C. 154(b) by 310 days.

(21) Appl. No.: 16/319,320

(22) PCT Filed: Jul. 17, 2017

(86) PCT No.: PCT/CN2017/093240
§ 371 (c)(1),
(2) Date: Jun. 14, 2019

(87) PCT Pub. No.: WO2018/014818
PCT Pub. Date: Jan. 25, 2018

(65) Prior Publication Data

US 2019/0293352 A1 Sep. 26, 2019

(30) Foreign Application Priority Data

Jul. 18, 2016 (CN) ..... 201610563365.4

(51) Int. Cl.
*F27B 9/30* (2006.01)
*F27B 9/24* (2006.01)
(Continued)

(52) U.S. Cl.
CPC ..... *F27B 9/3005* (2013.01); *F27B 9/12* (2013.01); *F27B 9/2407* (2013.01); *F27D 17/004* (2013.01)

(58) Field of Classification Search
CPC ..... F27B 9/2469; F27B 9/029; F27B 9/147; F27B 9/12; F27B 9/3005; F27B 9/2407; F27D 17/004
See application file for complete search history.

(56) References Cited

U.S. PATENT DOCUMENTS 1,465,572 A * 8/1923 Bailey ..... F27B 9/262 432/137
4,448,117 A * 5/1984 Wells ..... A47J 37/044 126/19 R
4,560,350 A * 12/1985 Doby ..... F27D 3/123 432/137

FOREIGN PATENT DOCUMENTS

CN 200965415 10/2007
CN 101839635 9/2010
(Continued)

OTHER PUBLICATIONS

"International Search Report (Form PCT/ISA/210) of PCT/CN2017/093240," dated Oct. 31, 2017, with English translation thereof, pp. 1-4.

*Primary Examiner* — Steven S Anderson, II
(74) *Attorney, Agent, or Firm* — JCIP Global Inc.

(57) ABSTRACT

An industrial kiln employs a tunnel kiln design. An upper portion of a central high-temperature firing region of a kiln body (1) has an arch structure, and is divided into a rising portion (4), a middle portion (5), and a descending portion (6). The rising portion (4), the middle portion (5), and the descending portion (6) are connected by means of curved surfaces with smooth transitions. A transporting mechanism (2) at a lower portion of the kiln body (1) is parallel to the upper portion. The present invention enables collection of excessive heat in a pre-heating portion and a cooling portion to transfer the same to a high-temperature firing portion, thus reducing a firing time and burning fuels of a high-tempera-
(Continued)

ture firing region, lowering a production cost, and protecting the environment by preventing exhaustion of a large amount of hot air.

13 Claims, 3 Drawing Sheets

(51) Int. Cl.
*F27D 17/00* (2006.01)
*F27B 9/12* (2006.01)

(56) References Cited

FOREIGN PATENT DOCUMENTS

| | | | | | |
|---|---|---|---|---|---|
| CN | 106017073 | | | 10/2016 | |
| CN | 205957704 | | | 2/2017 | |
| DE | 505603 | C | * | 8/1930 | ..... F27B 9/36 |
| DE | 2707510 | | | 9/1977 | |
| EP | 2684967 | A1 | * | 1/2014 | ..... F27B 9/147 |
| WO | WO-2010029430 | A1 | * | 3/2010 | ..... F27D 3/12 |

* cited by examiner

INDUSTRIAL KILN

CROSS-REFERENCE TO RELATED APPLICATION

This is a 371 application of the International PCT application serial no. PCT/CN2017/093240, filed on Jul. 17, 2017 which claims the priority benefit of China Application No. 201610563365.4 filed on Jul. 18, 2016. The entirety of each of the above-mentioned patent applications is hereby incorporated by reference herein and made a part of this specification.

BACKGROUND

Technical Field

The present invention relates to the field of kiln technologies, and specifically, to an industrial kiln employing a tunnel kiln design.

Description of Related Art

The kiln is a device built of refractory materials for firing products, and is an essential facility in ceramic molding. Considerable kiln building styles and experience have been accumulated in the history of ceramics burning for thousands of years. From the ground open-air pile burning and pit digging building burning of the primitive society to the steamed-bun-shaped up-draft circular kiln, the half-down-draft horseshoe-shaped kiln, the Banpo dragon kiln, the duck-egg-shaped kiln, and to the modern indoor gas kiln and electric kiln, kiln technologies are subject to continuous improvement and development.

The tunnel kiln is a modern continuous firing thermal equipment widely used in roasting production of ceramic products. It is also used in the metallurgical industry such as abrasives. The tunnel kiln is usually a long linear tunnel with fixed walls and a vault respectively on two sides and an upper portion thereof. A kiln cart runs on a track laid at the bottom of the tunnel kiln. A combustion device is disposed on two central sides of the tunnel kiln, to form a fixed high-temperature firing region. High-temperature gas generated by combustion flows along the tunnel to the direction of a kiln head under the effect of a chimney or an induced draft fan at a front end of the tunnel kiln, and gradually preheats products entering the kiln. This section forms the pre-heating region of the tunnel kiln. Cold air is blown into a kiln tail of the tunnel kiln, to cool products in a next section in the tunnel kiln. The blown cold air flows through the products and is heated, and is then extracted into a dryer as a heat source for drying a green blank. This section forms a cooling region of the tunnel kiln.

The tunnel kiln is a continuous kiln, and therefore has relatively high heat utilization, and combustion air used in most tunnel kilns is natural wind or cold air is blown into the cooling region to heat the air. Although waste heat is utilized, because extracted hot air contains a large amount of exhaust gas burnt in the high-temperature region, oxygen in the combustion air is insufficient and the combustion effect is not good. Hot air exchanged by a heat exchanger is fresh hot air, and can achieve an optimum combustion supporting effect. If a metal heat exchanger is used, some of the waste heat can be recovered, but if the temperature of the cooling region reaches 800 degrees or more, the metal heat exchanger is easily damaged by high temperature.

SUMMARY

In views of the foregoing existing technical problems, the present invention aims to provide an industrial kiln, employing a tunnel kiln design, and the main objective is to fully use excessive heat of a pre-heating region and a cooling region of a tunnel kiln to transfer the same to a high-temperature firing region, thereby reducing fuels required in the high-temperature firing region, lowering a cost, and also reducing exhaustion of hot air from the tunnel kiln to the outside, and reducing a temperature of a production shop. In this way, the use of a large-power air extractor can be reduced or even avoided, and thus consumption of electric energy is reduced.

To achieve the foregoing objective, the technical solution disclosed in the present invention is as follows:

An industrial kiln, employing a tunnel kiln design, and including a kiln body and a transporting mechanism that is configured to convey a member to be fired to pass through an internal chamber of the kiln body. The kiln body is of a structure with an arched middle portion, and includes a rising portion, a middle portion, and a descending portion. A front end of the rising portion is connected to a front horizontal portion, and a rear end of the descending portion is connected to a rear horizontal portion. The transporting mechanism passes through the internal chamber of the kiln body in a parallel manner, and therefore the transporting mechanism is also correspondingly divided into a front horizontal portion, a rising portion, a middle portion, a descending portion, and a rear horizontal portion. In the transporting mechanism, the front horizontal portion and the rising portion, the rising portion and the middle portion, the middle portion and the descending portion, and the descending portion and the rear horizontal portion are connected by means of curved surfaces with smooth transitions, respectively. The middle portion is a portion with a highest temperature in the kiln body, and a high-temperature firing region is formed in the middle portion. At least one part of the front horizontal portion and at least one part of the rising portion form a pre-heating region with a gradually increasing temperature, and at least one part of the descending portion and at least one part of the rear horizontal portion form a cooling region with a gradually decreasing temperature. The transporting mechanism conveys the member to be fired to sequentially pass through the front horizontal portion, the rising portion, the middle portion, the descending portion, and the rear horizontal portion.

In this technical solution, an upper portion of the central high-temperature firing region of the kiln body has an arch structure, and the pre-heating portion and the cooling portion are respectively disposed on two sides of the high-temperature firing region. According to a principle that heated air ascends upwards, hot air generated in the pre-heating portion and the cooling portion passes through the rising portion and the descending portion of the high-temperature firing region upwards and concentrates into the middle portion, to supplement heat in the middle portion. In this way, not only exhaustion of excessive heat from the pre-heating portion and the cooling portion to the outside can be reduced, but also fuels consumed in the high-temperature firing region can be reduced, thereby protecting the environment, and lowering a production cost.

In a further improvement of the present invention, at least one part of the middle portion of the industrial kiln runs horizontally.

In a further improvement of the present invention, an arch distance of the middle portion of the industrial kiln ranges from 1 time to 2 times an inner diameter of the internal chamber of the kiln body.

In a further improvement of the present invention, the transporting mechanism is in a form of a conveyor belt or a conveyor roller.

In a further improvement of the present invention, the transporting mechanism is in a form of a conveyor roller. Transporting is completed by several conveyor rollers rotating in a same direction. The conveyor rollers support a push plate for placing the member to be fired. The member to be fired or a carrier loading the member to be fired is placed on the push plate, and the conveyor rollers rotating in the same direction feed the push plate and the member to be fired placed on the push plate into the internal chamber of the kiln body for sintering.

In a further improvement of the present invention, the push plate employs a rectangular structure on the whole, and has an upper surface, a lower surface, and front, rear, left, and rear side surfaces. The lower surface of the push plate comes into contact with the conveyor rollers, and a recessed placing region is provided at a middle position of the upper surface to place the member to be fired or the carrier loading the member to be fired.

In a further improvement of the present invention, in at least a portion of the transporting mechanism that passes through the chamber of the kiln body, guardrails are disposed on two sides of the transporting mechanism. The left and right side surfaces of the push plate are recessed to form front-rear-through push plate grooves. Continuous protruding structures are disposed at corresponding positions of the guardrails on the two sides of the transporting mechanism to form guardrail protrusions. When the push plate advances on the conveyor rollers, the guardrail protrusions snap in the push plate grooves to avoid arch-up of the push plate.

In a further improvement of the present invention, in at least a portion of the transporting mechanism that passes through the chamber of the kiln body, guardrails are disposed on two sides of the transporting mechanism. Protruding structures are disposed on the left and right sides of the push plate to form push plate protrusions. Through grooves are disposed at positions of the guardrails that come into contact with the push plate protrusions to form guardrail grooves. When the push plate advances on the conveyor rollers, the push plate protrusions snap in the guardrail grooves.

In a further improvement of the present invention, in the front and rear side surfaces of the push plate, one has a protrusion and the other one has a left-right-through groove. When a plurality of push plates are on the conveyor rollers, corresponding protrusions and grooves of two push plates coming into contact in a front-rear direction can be engaged with each other.

In a further improvement of the present invention, a heat preservation layer is disposed outside an upright wall of the kiln body, and a thickness of the heat preservation layer is 8 cm to 12 cm.

Beneficial effect of the invention: compared with a conventional industrial kiln, in particular, a tunnel kiln, the present invention enables collection of excessive heat in a pre-heating portion and a cooling portion to transfer the same to a high-temperature firing portion, thus reducing a firing time and burning fuels of a high-temperature firing region, lowering a production cost, and protecting the environment by preventing exhaustion of a large amount of hot air. In the present invention, a push plate and an upright wall of a kiln body are connected in a snapping-like manner, such that it is ensured that no lift-up phenomenon occurs in an ascending process of a plurality of push plates, to facilitate transporting.

DESCRIPTION OF THE EMBODIMENTS

To deepen understanding of the present invention, the present invention will be further described in detail below with reference to the accompanying drawings and embodiments. The embodiments are used only to explain the present invention and are not intended to limit the protection scope of the present invention.

Embodiment 1

Figure 1:
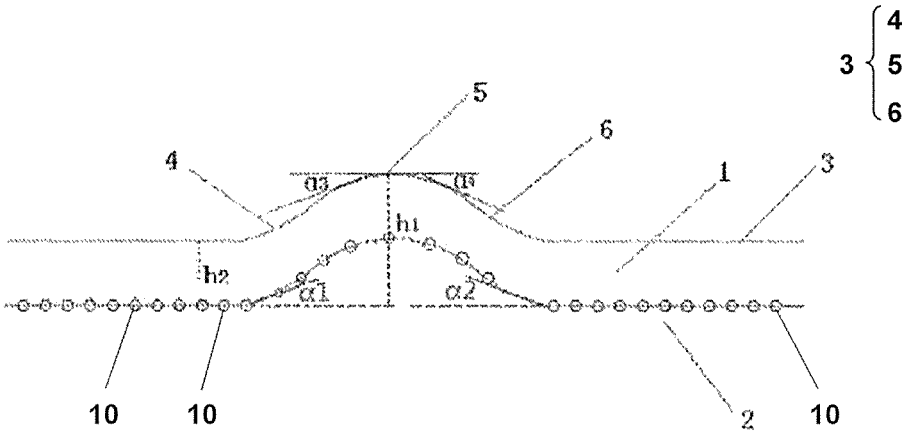
FIG. 1 is a schematic structural transverse sectional view of Embodiment 1 of the present invention.
Figure 4:
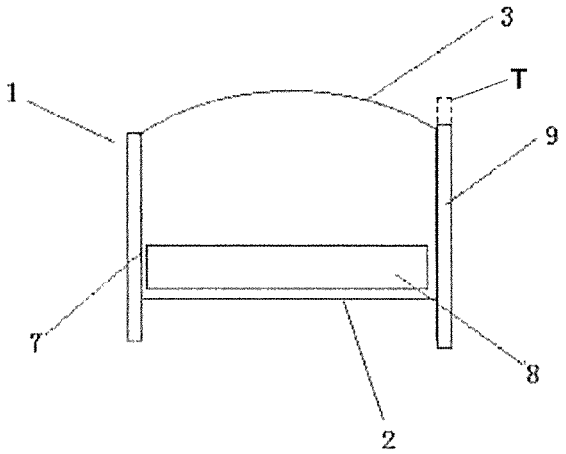
FIG. 4 is a schematic structural cross-sectional view of a kiln body of the present invention.
Figure 5:
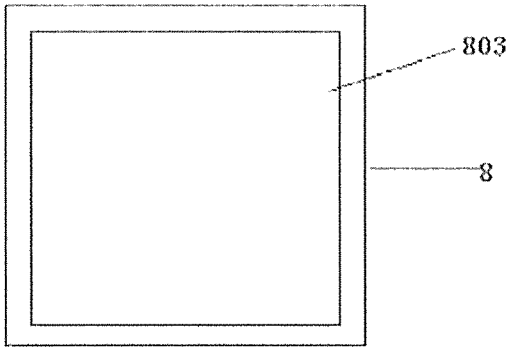
FIG. 5 is a schematic structural diagram of a push plate of the present invention.
Figure 6:
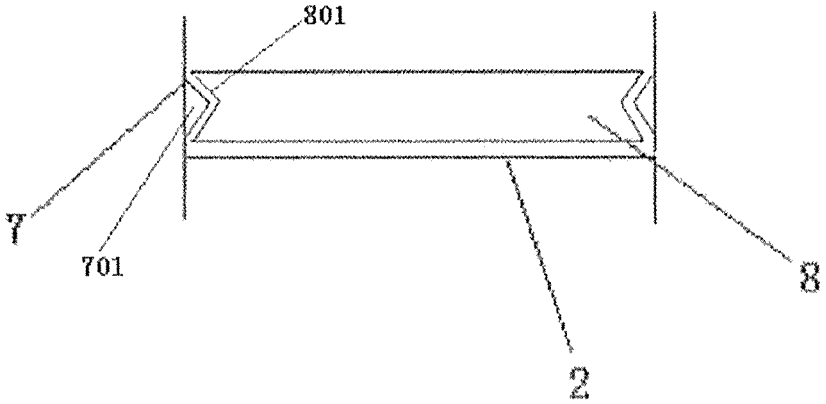
FIG. 6 is a schematic diagram of connection between a push plate and an upright wall of the present invention.
Figure 7:
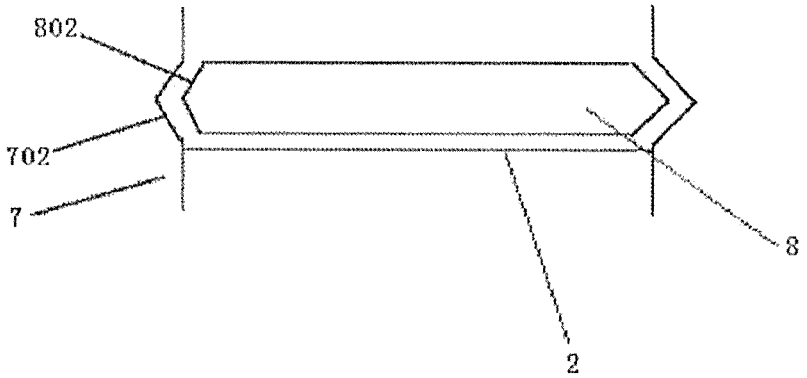
FIG. 7 is a schematic structural diagram of a variation of FIG. 4.
Figure 8:
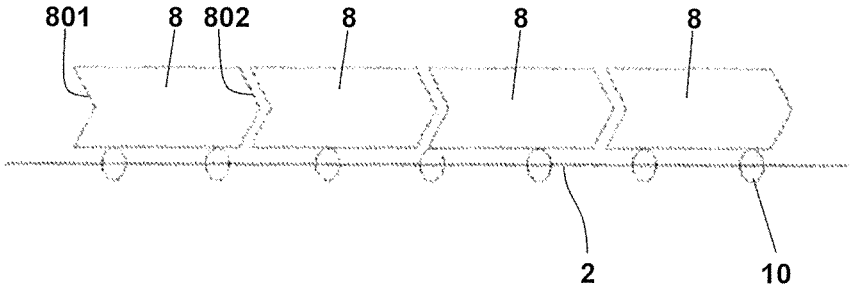
FIG. 8 is a schematic structural diagram of push plates connected in a front-rear direction of the present invention.

FIG. 1 shows an industrial kiln, employing a tunnel kiln design, and including a kiln body 1 and a transporting mechanism 2 that is configured to convey a member to be fired to pass through an internal chamber of the kiln body 1. The kiln body 1 is of a structure with an arched middle portion 3, and includes a rising portion 4, a middle portion 5, and a descending portion 6. A front end of the rising portion 4 is connected to a front horizontal portion, and a rear end of the descending portion 6 is connected to a rear horizontal portion. The transporting mechanism 2 passes through the internal chamber of the kiln body 1 in a parallel manner, and therefore the transporting mechanism 2 is also correspondingly divided into a front horizontal portion, a rising portion, a middle portion, a descending portion, and a rear horizontal portion. In the transporting mechanism 2, the front horizontal portion and the rising portion, the rising portion and the middle portion, the middle portion and the descending portion, and the descending portion and the rear horizontal portion are connected by means of curved surfaces with smooth transitions, respectively. The middle portion 5 is a portion with a highest temperature in the kiln body 1, and a high-temperature firing region is formed in the middle portion. At least one part of the front horizontal portion and at least one part of the rising portion 4 form a pre-heating region with a gradually increasing temperature, and at least one part of the descending portion 6 and at least one part of the rear horizontal portion form a cooling region with a gradually decreasing temperature. The transporting mechanism 2 conveys the member to be fired to sequentially pass through the front horizontal portion, the rising portion 4, the middle portion 5, the descending portion 6, and the rear horizontal portion. At least one part of the middle portion 5 of the industrial kiln runs horizontally. An arch distance of the middle portion of the industrial kiln ranges from 1 time to 2 times an inner diameter of the internal chamber of the kiln body 1. The transporting mechanism 2 is in form of a conveyor belt or a conveyor roller. In this embodiment, the transporting mechanism 2 is in a form of conveyor rollers (as shown in FIG. 4 and FIG. 8). Transporting is completed by several conveyor rollers rotating in a same direction. The conveyor rollers 10 support a push plate 8 for placing the member to be fired. The member to be fired or a carrier loading the member to be fired is placed on the push plate 8, and the conveyor rollers 10 rotating in the same direction feed the push plate 8 and the member to be fired placed on the push plate 8 into the internal chamber of the kiln body 1 for sintering. The push plate 8 employs a rectangular structure on the whole, and has an upper surface, a lower surface, and front, rear, left, and rear side surfaces. The lower surface of the push plate 8 comes into contact with the conveyor rollers 10, and a recessed placing region 803 is provided at a middle position of the upper surface to place the member to be fired or the carrier loading the member to be fired (as shown in FIG. 5). In at least a portion of the transporting mechanism 2 that passes through the chamber of the kiln body 1, guardrails 7 are disposed on two sides of the transporting mechanism 2. The left and right side surfaces of the push plate 8 are recessed to form front-rear-through push plate grooves 801. Continuous protruding structures are disposed at corresponding positions of the guardrails 7 on the two sides of the transporting mechanism 2 to form guardrail protrusions 701. When the push plate 8 advances on the conveyor rollers 10, the guardrail protrusions 701 snap in the push plate grooves 801 to avoid arch-up of the push plate 8 (as shown in FIG. 6). A variation may also be made. In at least a portion of the transporting mechanism 2 that passes through the chamber of the kiln body 1, guardrails 7 are disposed on two sides of the transporting mechanism 2. Protruding structures are disposed on the left and right sides of the push plate 8 to form push plate protrusions 802. Through grooves are disposed at positions of the guardrails 7 that come into contact with the push plate protrusions 802 to form guardrail grooves 702. When the push plate 8 advances on the conveyor rollers 10, the push plate protrusions 802 snap in the guardrail grooves 702 (as shown in FIG. 7). In the front and rear side surfaces of the push plate 8, one has a protrusion and the other one has a left-right-through groove. When a plurality of push plates 8 are on the conveyor rollers 10, corresponding protrusions and grooves of two push plates 8 coming into contact in a front-rear direction can be engaged with each other (as shown in FIG. 8). In this embodiment, a heat preservation layer 9 is disposed outside an upright wall of the kiln body 1, and a thickness of the heat preservation layer 9 is 8 cm to 12 cm (as shown in FIG. 4). An angle between the rising portion of the transporting mechanism and a horizontal line is $\alpha 1$, and an angle between the descending portion of the transporting mechanism and the horizontal line is $\alpha 2$, where $\alpha 1$ is equal to $\alpha 2$. Angles between a tangent line at a highest point of a middle portion of an upper portion and tangent lines of curved surfaces of the rising portion and the descending portion are $\alpha 3$ and $\alpha 4$, where $\alpha 3$ is equal to $\alpha 4$. A vertical distance between the highest point of the middle portion of the upper portion and the horizontal portion of the transporting mechanism is h1, and a vertical distance between the upper portion and the transporting mechanism is h2, where a ratio of h1 to h2 ranges from 2:1 to 3:1.

Embodiment 2

Figure 2:
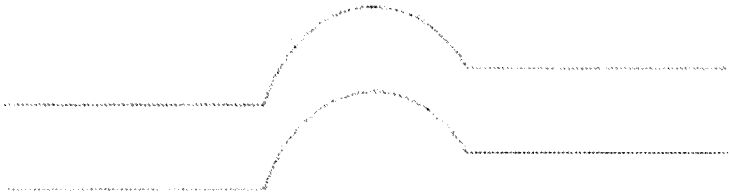
FIG. 2 is a schematic structural transverse sectional view of Embodiment 2 of the present invention.

FIG. 2 shows an industrial kiln, employing a tunnel kiln design, and including a kiln body and a transporting mechanism that is configured to convey a member to be fired to pass through an internal chamber of the kiln body, where the kiln body is of a structure with an arched middle portion, and includes a rising portion, a middle portion, and a descending portion. A front end of the rising portion is connected to a front horizontal portion, and a rear end of the descending portion is connected to a rear horizontal portion. The transporting mechanism passes through the internal chamber of the kiln body in a parallel manner, and therefore the transporting mechanism is also correspondingly divided into a front horizontal portion, a rising portion, a middle portion, a descending portion, and a rear horizontal portion, where in the transporting mechanism, the front horizontal portion and the rising portion, the rising portion and the middle portion, the middle portion and the descending portion, and the descending portion and the rear horizontal portion are connected by means of curved surfaces with smooth transitions, respectively. The middle portion is a portion with a highest temperature in the kiln body, and a high-temperature firing region is formed in the middle portion. At least one part of the front horizontal portion and at least one part of the rising portion form a pre-heating region with a gradually increasing temperature, and at least one part of the descending portion and at least one part of the rear horizontal portion form a cooling region with a gradually decreasing temperature. The transporting mechanism conveys the member to be fired to sequentially pass through the front horizontal portion, the rising portion, the middle portion, the descending portion, and the rear horizontal portion. In this embodiment, the front horizontal portion and the rear horizontal portion of the kiln body are not on a same horizontal line. Similarly, the front horizontal portion and the rear horizontal portion of the transporting mechanism are not on a same horizontal line, either. This design makes the pre-heating region and the cooling region of the kiln have different horizontal heights. Correspondingly, amounts of heat transferred to the central high-temperature firing region are not the same, there is a temperature difference, and the temperature of the cooling portion is transferred to the high-temperature firing region to the greatest extent. Other parts are the same as those of Embodiment 1.

Embodiment 3

Figure 3:
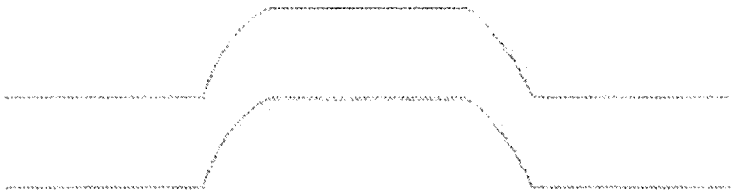
FIG. 3 is a schematic structural transverse sectional view of Embodiment 3 of the present invention.

FIG. 3 shows an industrial kiln, employing a tunnel kiln design, and including a kiln body and a transporting mechanism that is configured to convey a member to be fired to pass through an internal chamber of the kiln body, where the kiln body is of a structure with an arched middle portion, and includes a rising portion, a middle portion, and a descending portion. A front end of the rising portion is connected to a front horizontal portion, and a rear end of the descending portion is connected to a rear horizontal portion. The transporting mechanism passes through the internal chamber of the kiln body in a parallel manner, and therefore the transporting mechanism is also correspondingly divided into a front horizontal portion, a rising portion, a middle portion, a descending portion, and a rear horizontal portion, where in the transporting mechanism, the front horizontal portion and the rising portion, the rising portion and the middle portion, the middle portion and the descending portion, and the descending portion and the rear horizontal portion are connected by means of curved surfaces with smooth transitions, respectively. The middle portion is a portion with a highest temperature in the kiln body, and a high-temperature firing region is formed in the middle portion. At least one part of the front horizontal portion and at least one part of the rising portion form a pre-heating region with a gradually increasing temperature, and at least one part of the descending portion and at least one part of the rear horizontal portion form a cooling region with a gradually decreasing temperature. The transporting mechanism conveys the member to be fired to sequentially pass through the front horizontal portion, the rising portion, the middle portion, the descending portion, and the rear horizontal portion. In this embodiment, a horizontal distance of the high-temperature firing region in the middle portion is relatively long, so that a high-temperature sintering time is prolonged, and sintering of the member to be fired is more sufficient, thereby improving the sintering effect. Other parts are the same as those of Embodiment 1.

The basic principles, main features and advantages of the present invention have been shown and described above. It should be understood by those skilled in the art that the present invention is not limited by the foregoing embodiments, the foregoing embodiments and description are only used to describe the principles of the present invention, and various modifications and improvements of the present invention can be further made without departing from the spirit and scope of the present invention, and these modifications and improvements all fall within the scope of the present invention. The protection scope of the present invention is defined by the appended claims and their equivalents.

What is claimed is:

1. An industrial kiln, comprising a kiln body and a transporting mechanism that is configured to convey a member to be fired to pass through an internal chamber of the kiln body, wherein the kiln body has an arched structure, and the arched structure comprises a rising portion, a descending portion, and a middle portion connecting the rising portion and the descending portion; a front end of the rising portion is connected to a front horizontal portion of the kiln body, and a rear end of the descending portion is connected to a rear horizontal portion of the kiln body;

the transporting mechanism passes through the internal chamber of the kiln body in a parallel manner, and the transporting mechanism is correspondingly divided into a front horizontal portion, a rising portion, a middle portion, a descending portion, and a rear horizontal portion that are successively connected;

the middle portion of the kiln body is a portion with a highest temperature in the kiln body, and a high-temperature firing region is formed in the middle portion of the kiln body; at least one part of the front horizontal portion of the kiln body and at least one part of the rising portion of the kiln body form a pre-heating region with a gradually increasing temperature, and at least one part of the descending portion of the kiln body and at least one part of the rear horizontal portion of the kiln body form a cooling region with a gradually decreasing temperature;

the transporting mechanism conveys the member to be fired to sequentially pass through the front horizontal portion, the rising portion, the middle portion, the descending portion, and the rear horizontal portion;

a vertical distance between a highest point of the arched structure and a point of the front horizontal portion of the kiln body is larger than a vertical distance between the highest point of the arched structure and a point of the rear horizontal portion; and a horizontal length of the middle portion is longer than a horizontal length of the rising portion and longer than a horizontal length of the descending portion.

2. The industrial kiln according to claim 1, wherein the high-temperature firing region in the middle portion has a longer length than the horizontal length of the rising portion and the horizontal length of the descending portion.

3. The industrial kiln according to claim 1, wherein a ratio of a vertical distance between a highest point of the middle portion of the kiln body and a point of the front horizontal portion of the transporting mechanism to a vertical distance between a point of the front horizontal portion of the kin body and the point of the front horizontal portion of the transporting mechanism ranges from 2:1 to 3:1.

4. The industrial kiln according to claim 1, wherein the transporting mechanism is in a form of a conveyor belt or conveyor rollers.

5. The industrial kiln according to claim 4, wherein the transporting mechanism is in a form of conveyor rollers; transporting is completed by several conveyor rollers rotating in a same direction; the conveyor rollers support a push plate for placing the member to be fired; the member to be fired or a carrier loading the member to be fired is placed on the push plate, and the conveyor rollers rotating in the same direction feed the push plate and the member to be fired placed on the push plate into the internal chamber of the kiln body for sintering.

6. The industrial kiln according to claim 5, wherein the push plate employs a rectangular structure, and has an upper surface, a lower surface, and front, rear, left, and rear side surfaces; the lower surface of the push plate comes into contact with the conveyor rollers, and a recessed placing region is provided at a middle position of the upper surface to place the member to be fired or the carrier loading the member to be fired.

7. The industrial kiln according to claim 6, wherein in at least a portion of the transporting mechanism that passes through the internal chamber of the kiln body, guardrails are disposed on two sides of the transporting mechanism; the left and right side surfaces of the push plate are recessed to form front-rear-through push plate grooves; continuous protruding structures are disposed at corresponding positions of the guardrails on the two sides of the transporting mechanism.

8. The industrial kiln according to claim 6, wherein in at least a portion of the transporting mechanism that passes through the internal chamber of the kiln body, guardrails are disposed on two sides of the transporting mechanism; protruding structures are disposed on the left and right sides of the push plate to form push plate protrusions; through grooves are disposed at positions of the guardrails that correspond to the push plate protrusions.

9. The industrial kiln according to claim 6, wherein in the front and rear side surfaces of the push plate, one has a protrusion and the other one has groove.

10. The industrial kiln according to claim 1, wherein a heat preservation layer is disposed outside an upright wall of the kiln body, and a thickness of the heat preservation layer is 8 cm to 12 cm.

11. The industrial kiln according to claim 2, wherein a ratio of a vertical distance between a highest point of the middle portion of the kiln body and a point of the front horizontal portion of the transporting mechanism to a vertical distance between a point of the front horizontal portion of the kin body and the point of the front horizontal portion of the transporting mechanism ranges from 2:1 to 3:1.

12. The industrial kiln according to claim 2, wherein the transporting mechanism is in a form of a conveyor belt or conveyor rollers.

13. The industrial kiln according to claim 2, wherein a heat preservation layer is disposed outside an upright wall of the kiln body, and a thickness of the heat preservation layer is 8 cm to 12 cm.

* * * * *